US007532177B2

(12) United States Patent
Kwon et al.

(10) Patent No.: US 7,532,177 B2
(45) Date of Patent: May 12, 2009

(54) METHOD AND APPARATUS FOR DRIVING A PLASMA DISPLAY PANEL

(75) Inventors: Chang Young Kwon, Pohang-si (KR); Seong Ho Kang, Daegu (KR); Hee Jae Kim, Gumi-si (KR); Jeong Pil Choi, Suwon-si (KR)

(73) Assignee: LG Electronics Inc., Seoul (KR)

( * ) Notice: Subject to any disclaimer, the term of this patent is extended or adjusted under 35 U.S.C. 154(b) by 572 days.

(21) Appl. No.: 11/024,017

(22) Filed: Dec. 29, 2004

(65) Prior Publication Data

US 2005/0162345 A1 Jul. 28, 2005

(30) Foreign Application Priority Data

Dec. 31, 2003 (KR) ..... 10-2003-0102176

(51) Int. Cl.
*G09G 3/28* (2006.01)

(52) U.S. Cl. ..... 345/60; 345/63

(58) Field of Classification Search ..... 315/169.1; 345/60, 63, 68, 67

See application file for complete search history.

(56) References Cited

U.S. PATENT DOCUMENTS

| | | | | |
|---|---|---|---|---|
| 5,854,540 | A * | 12/1998 | Matsumoto et al. | 315/169.1 |
| 6,294,875 | B1 | 9/2001 | Kurata et al. | |
| 6,633,269 | B2 * | 10/2003 | Huang et al. | 345/63 |
| 2001/0017605 | A1 * | 8/2001 | Hashimoto et al. | 345/60 |
| 2002/0118149 | A1 * | 8/2002 | Tanaka et al. | 345/60 |
| 2003/0030598 | A1 * | 2/2003 | Kanazawa et al. | 345/60 |
| 2004/0196216 | A1 | 10/2004 | Shindo et al. | |
| 2004/0233134 | A1 | 11/2004 | Shindo et al. | |
| 2005/0073485 | A1 * | 4/2005 | Kim et al. | 345/63 |
| 2005/0156823 | A1 * | 7/2005 | Kang et al. | 345/60 |

FOREIGN PATENT DOCUMENTS

| | | |
|---|---|---|
| CN | 1271158 | 10/2000 |
| EP | 1022715 A2 | 7/2000 |
| EP | 1182634 A2 | 2/2002 |
| EP | 1195739 A2 | 4/2002 |

(Continued)

*Primary Examiner*—Amare Mengistu
*Assistant Examiner*—Yuk Chow
(74) *Attorney, Agent, or Firm*—McKenna Long & Aldridge LLP

(57) ABSTRACT

Disclosed herein is a method and apparatus for driving a plasma display panel, which improves contrast characteristics and preventing a low discharge making a cell non-luminous at a specific gray scale. The method for driving a plasma display panel includes the steps of initializing a cell by supplying a first write voltage and an erase voltage to a scanning electrode during a reset interval of the n-th sub-field; initializing the cell by supplying the erase voltage and a second write voltage which is higher than a sustaining voltage and lower than the first write voltage to the scanning electrode during a reset interval of the (n+1)-th sub-field; selecting the cell by supplying the scanning voltage to the scanning electrode and supplying a data voltage to an address electrode during an address interval of each of the n-th and (n+1)-th sub-fields; and alternatively supplying the sustaining voltage to the scanning and sustaining electrodes during a sustaining interval of each of the n-th and (n+1 )-th sub-fields.

13 Claims, 10 Drawing Sheets

FOREIGN PATENT DOCUMENTS

| | | |
|---|---|---|
| JP | 2002-108278 | 4/2002 |
| JP | 2003-050563 | 2/2003 |
| JP | 2003-076320 | 3/2003 |
| KR | 1020030088391 | 11/2003 |
| KR | 1020030088391 A | 11/2003 |

* cited by examiner

METHOD AND APPARATUS FOR DRIVING A PLASMA DISPLAY PANEL

This Nonprovisional application claims priority under 35 U.S.C. § 119(a) on Patent Application No. 10-2003-0102176 filed in Korea on Dec. 31, 2003, the entire contents of which are hereby incorporated by reference.

BACKGROUND OF THE INVENTION

1. Field of the Invention

The present invention relates to a plasma display panel, and more particularly to a plasma display panel driving method and apparatus for improving contrast characteristics and preventing a low discharge making a cell non-luminous at a specific gray scale.

2. Description of the Background Art

A plasma display panel (PDP) displays images by radiating phosphors by ultraviolet rays generated during a discharge of a mixture gas of He+Xe, Ne+Xe, He+Xe+Ne, etc. The PDP is easy to make its thickness thin and its display screen size large, and its picture quality has greatly been improved due to a recent technical development.

Referring to FIG. 1, a conventional three-electrode AC (Alternative Current) surface-discharge type PDP includes scanning electrodes Y1 through Yn, sustaining electrodes Z, and address electrodes 1 through Xm which are perpendicular to the scanning electrodes Y1 through Yn and to the sustaining electrodes Z.

Cells 1 for respectively displaying one of red (R), green (G) and blue (B) are formed at points where the scanning electrodes Y1 through Yn, the sustaining electrodes Z and the address electrodes X1 through Xm intersect. The scanning electrodes Y1 through Yn and the sustaining electrodes Z are formed on an upper substrate (not shown). A dielectric layer and a protective layer of magnesium oxide (MgO) are formed on the upper substrate. The address electrodes X1 through Xm are formed on a lower substrate (not shown). Barrier ribs are formed on the lower substrate to prevent horizontally adjacent cells from interfering with one another optically and electrically. A florescent material layer is coated on the surfaces of the lower dielectric layer and the barrier ribs. The florescent material layer is excited by an ultraviolet ray and irradiates a visible light ray. A mixture gas of He+Xe, Ne+Xe, He+Xe+Ne etc. for a gas discharge is injected into a discharge space formed between the upper and lower substrates.

In order to achieve a gray scale of an image, the PDP is driven on a time-division basis by dividing one frame into sub-fields each having the different number of light emissions. Each sub-field is again divided into a reset interval for resetting the entire screen, an address interval for selecting a scanning line and selecting a cell in the selected scanning line, and a sustaining interval for achieving a gray scale according to the number of discharges. For example, if it is desired to display an image by 256-level gray scale, one frame interval corresponding to 1/60 seconds (16.67 ms) is divided into 8 sub-fields SF1 through SF8, as shown in FIG. 2. Each of the 8 subframes SF1 through SF8 is further divided into the reset interval, the address interval and the sustaining interval as described above. The reset and address intervals in each subfield are identical with respect to the respective sub-fields, whereas the sustaining interval and the number of sustaining pulses assigned thereto increase at the rate of $2^n$ (where n=0, 1, 2, 3, 4, 5, 6 and 7).

FIG. 3 illustrates an example of a driving waveform applied to the PDP.

Referring to FIG. 3, in a convention PDP driving method, cells for respective sub-fields SFn and SFn+1 are initialized by creating a set-up discharge using a ramp-up waveform and creating a set-down discharge using a ramp-down waveform.

During the reset interval of each of the sub-fields SFn and SFn+1, a ramp-up waveform is simultaneously applied to all the scanning electrodes Y, and at the same time, a 0V (zero volts) voltage is supplied to the sustaining electrodes Z and the address electrodes X. By this ramp-up waveform, a se-up discharge occurs between the scanning electrodes Y and the address electrode X and between the scanning electrodes Y and the sustaining electrodes Z within the cells of the entire screen. By this set-up discharge, positive wall charges are created on the address electrodes X and the sustaining electrodes Z and negative wall carriers are created on the scanning electrodes Y.

After the ramp-up waveform is supplied, a ramp-down waveform falling from a sustaining voltage Vs lower than a set-up voltage Vsetup of the ramp-up waveform to a negative specific voltage is simultaneously applied to the scanning electrodes Y. At the same time, a first sustaining bias voltage Vz1 is supplied to the sustaining electrodes Z and a 0V voltage is supplied to the address electrodes Z. The first sustaining bias voltage Vz1 may be defined as the sustaining voltage Vs. When the ramp-down waveform is supplied, a set-down discharge occurs between the scanning electrodes Y and the sustaining electrodes Z. This set-down discharge erases excessive wall charges unnecessary for an address discharge out of the wall charges generated during the set-up discharge.

During the address interval of each of the sub-field SFn and SFn+1, a scanning pulse Scp of a negative write voltage −Vw is sequentially applied to the scanning electrodes Y and at the same time a data pulse Dp of a positive data voltage Vd synchronized with the scanning pulse Scp is applied to the address electrodes X. The scanning pulse Scp swings between a positive bias voltage Vw lower than the sustaining voltage Vs and the negative write voltage Vw. The voltage of the scanning pulse Scp, the voltage of the data pulse Dp and a wall voltage generated during the reset interval are added to create the address discharge within the cell to which the data pulse Dp is supplied. During this address interval, a second sustaining bias voltage Vz2 lower than the first sustaining bias voltage Vz1 is supplied to the sustaining electrodes Z.

During the sustaining interval of each of the sub-fields SFn and SFn+1, a sustaining pulse Susp of the sustaining voltage Vs is alternatively applied to the scanning electrodes Y and the sustaining electrodes Z. The cell selected by the address discharge creates a sustaining discharge, that is, a display discharge between the scanning electrode Y and the sustaining electrode Z whenever each sustaining pulse Susp is applied, as the wall voltage within the cell is added to the sustaining voltage Vs.

After the sustaining discharge is completed, an erase signal for erasing the remaining charges within the cell may be supplied to the scanning electrodes Y or the sustaining electrodes Z.

In the driving waveform shown in FIG. 3, the set-down voltage of the ramp-down waveform at a time t1 when the set-down discharge is completed is fixed to a voltage higher than the negative write voltage Vw of the scanning pulse Scp by ΔV. Since the ramp-down waveform serves to reduce the positive wall charges on the address electrode X which are excessively accumulated by the set-up discharge, if the set-down voltage of the ramp-down waveform stops at a voltage higher than the negative write voltage Vw, more positive wall charges may remain on the address electrode X. The driving waveform shown in FIG. 3 can lower the voltages Vd and Vw necessary for the address discharge, and therefore, the PDP can be driven at a low voltage. The reason why the voltage supplied to the sustaining electrode Z is lowered to Vz2 during the address interval is to compensate for the amount of the positive wall charges remaining excessively on the sustaining electrode Z when the set-down voltage is raised to ΔV during the set-down discharge.

FIG. 4 illustrates another example of a driving waveform applied to the PDP.

Referring to FIG. 4, the n-th sub-field SFn initializes cells by a set-up discharge and a set-down discharge, and the (n+1)-th sub-field SFn+1 initializes the cells by the set-down discharge without the set-up discharge.

The address interval and the sustaining interval in each of the sub-fields SFn and SFn+1 are substantially the same as those shown in FIG. 3.

During the reset interval, the n-th sub-field SFn initializes cells by creating the set-up discharge using the ramp-up waveform and then creating the set-down discharge using the ramp-down waveform. Meanwhile, the (n+1)-th sub-field SFn+1 initializes the cells by supplying to the scanning electrodes Y the ramp-down waveform connected to the last sustaining pulse of the scanning electrodes Y. Unlike the n-th sub-field SFn, the (n+1)-th sub-field SFn+1 creates the set-down discharge after the sustaining discharge without the set-up discharge. Since the set-up discharge does not occur during the reset interval of the (n+1)-th sub-field SFn+1, light is emitted only from on-cells where the sustaining discharge occurs in the n-th sub-field SFn. Therefore, the driving waveform shown in FIG. 4 has higher contrast characteristics than the driving waveform of FIG. 3 in which the set-up discharge occurs in all the sub-fields and light is emitted from all the cells.

However, the driving waveform shown in FIG. 4 is liable to undergo a low-discharge phenomenon that on-cells are not driven at a specific gray scale when the amount of space charges is small in space and time because of the sub-fields having no set-up discharge. For example, in <Table 1> shown below, a cell to which data is supplied in a gray scale 4 should be an on-cell in the third sub-field SF3. However, a discharge may not occur because there are almost no space charges. Further, a cell to which data is supplied in a gray scale 8 should be an on-cell in the fourth sub-field SF4. However, a discharge may not occur because there are almost no space charges. FIG. 5 illustrates a low-discharge phenomenon appearing at a specific gray scale when the PDP is driven by the driving waveform of FIG. 4. In FIG. 5, a reference symbol W designates white chromacity.

TABLE 1

| Gray scale | SF1(1) | SF2(2) | SF3(4) | SF4(8) | SF5(16) |
|---|---|---|---|---|---|
| 4 | 0 | 0 | 1 (0) | 0 | 0 |
| 5 | 1 | 0 | 1 | 0 | 0 |
| 6 | 0 | 1 | 1 | 0 | 0 |
| 7 | 1 | 1 | 1 | 0 | 0 |
| 8 | 0 | 0 | 0 | 1 (0) | 0 |
| 9 | 1 | 0 | 0 | 1 | 0 |
| 10 | 0 | 1 | 0 | 1 | 0 |
| 11 | 1 | 1 | 0 | 1 | 0 |
| 12 | 0 | 0 | 1 | 1 | 0 |
| 13 | 1 | 0 | 1 | 1 | 0 |
| 14 | 0 | 1 | 1 | 1 | 0 |
| 15 | 1 | 1 | 1 | 1 | 0 |

In <Table 1>, 1 and 0 designate a light emitting cell and a non-luminous cell, respectively, in each sub-field depending to the gray scale. Parenthesized numerals in the uppermost row designate a luminance weighting value assigned to each sub-field.

SUMMARY OF THE INVENTION

Accordingly, the present invention has been made in view of the above problems occurring in the prior art, and it is an object of the present invention to provide a method and apparatus for driving a plasma display panel (PDP), which improves contrast characteristics and prevents a low discharge making a cell non-luminous at a specific gray scale.

In accordance with one aspect of the present invention, there is provided a method for driving a plasma display panel, including the steps of: initializing a cell by supplying a first write voltage and an erase voltage to a scanning electrode during a reset interval of the n-th sub-field; initializing the cell by supplying the erase voltage and a second write voltage which is higher than a sustaining voltage and lower than the first write voltage to the scanning electrode during a reset interval of the (n+1)-th sub-field; selecting the cell by supplying the scanning voltage to the scanning electrode and supplying a data voltage to an address electrode during an address interval of each of the n-th and (n+1)-th sub-fields; and alternatively supplying the sustaining voltage to the scanning and sustaining electrodes during a sustaining interval of each of the n-th and (n+1)-th sub-fields.

In accordance with another aspect of the present invention, there is provided a method for driving a plasma display panel including the steps of: initializing a cell by supplying a write voltage and an erase voltage to a scanning electrode during a reset interval of the n-th sub-field; initializing the cell by supplying the write voltage and the erase voltage to the scanning electrode during a reset interval of the (n+1)-th sub-field and supplying a bias voltage to a sustaining electrode during a time interval between a starting time of supplying the write voltage and a starting time of supplying the erase voltage; selecting the cell by supplying the scanning voltage to the scanning electrode and supplying a data voltage to an address electrode during an address interval of each of the n-th and (n+1)-th sub-fields; and alternatively supplying the sustaining voltage to the scanning and sustaining electrodes during a sustaining interval of each of the n-th and (n+1)-th sub-fields.

In accordance with a further aspect of the present invention, there is provided an apparatus for driving a plasma display panel, the apparatus including: a first driver for supplying a first write voltage and a first erase voltage to a scanning electrode during a reset interval of the n-th sub-field and supplying a second erase voltage and a second write voltage which is higher than a sustaining voltage and lower than the first write voltage to the scanning electrode during a reset interval of the (n+1)-th sub-field; a second driver for supplying a scanning voltage to the scanning electrode and supplying a data voltage to an address electrode during an address interval of each of the n-th and (n+1)-th sub-fields; and a third driver for alternatively supplying a sustaining voltage to the scanning electrode and a sustaining electrode during a sustaining interval of each of the n-th and (n+1)-th sub-field.

In accordance with still another aspect of the present invention, there is provided an apparatus for driving a plasma display panel, the apparatus including: a first driver for supplying a write voltage and an erase voltage to the scanning electrode during a reset interval of the n-th sub-field, supplying the write voltage and the erase voltage to the scanning electrode during a reset interval of the (n+1)-th sub-field, and supplying a bias voltage to a sustaining electrode during a time interval between a starting time of supplying the write voltage and a starting time of supplying the erase voltage; a second driver for supplying the scanning voltage to the scanning electrode and supplying a data voltage to an address electrode during an address interval of each of the n-th and (n+1)-th sub-fields; and a third driver for alternatively supplying the sustaining voltage to the scanning and sustaining electrodes during a sustaining interval of each of the n-th and (n+1)-th sub-fields.

A method and apparatus for driving a plasma display panel according to the present invention display an image by time-dividing a frame into at least one sub-field with a set-up discharge and at least one sub-field without a set-up discharge. In the sub-field without the set-up discharge, a write discharge is performed by a voltage higher than a sustaining voltage during an initial reset interval and then a cell initialized by a set-down discharge causing wall charges to be erased. Alternatively, immediately after s sustaining voltage is supplied to a scanning electrode, a positive bias voltage is supplied to a sustaining electrode without the set-up discharge. Therefore, contrast characteristics can be improved and a low discharge making a cell non-luminous at a specific gray-scale can be prevented.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF PREFERRED EMBODIMENTS

Figure 1:
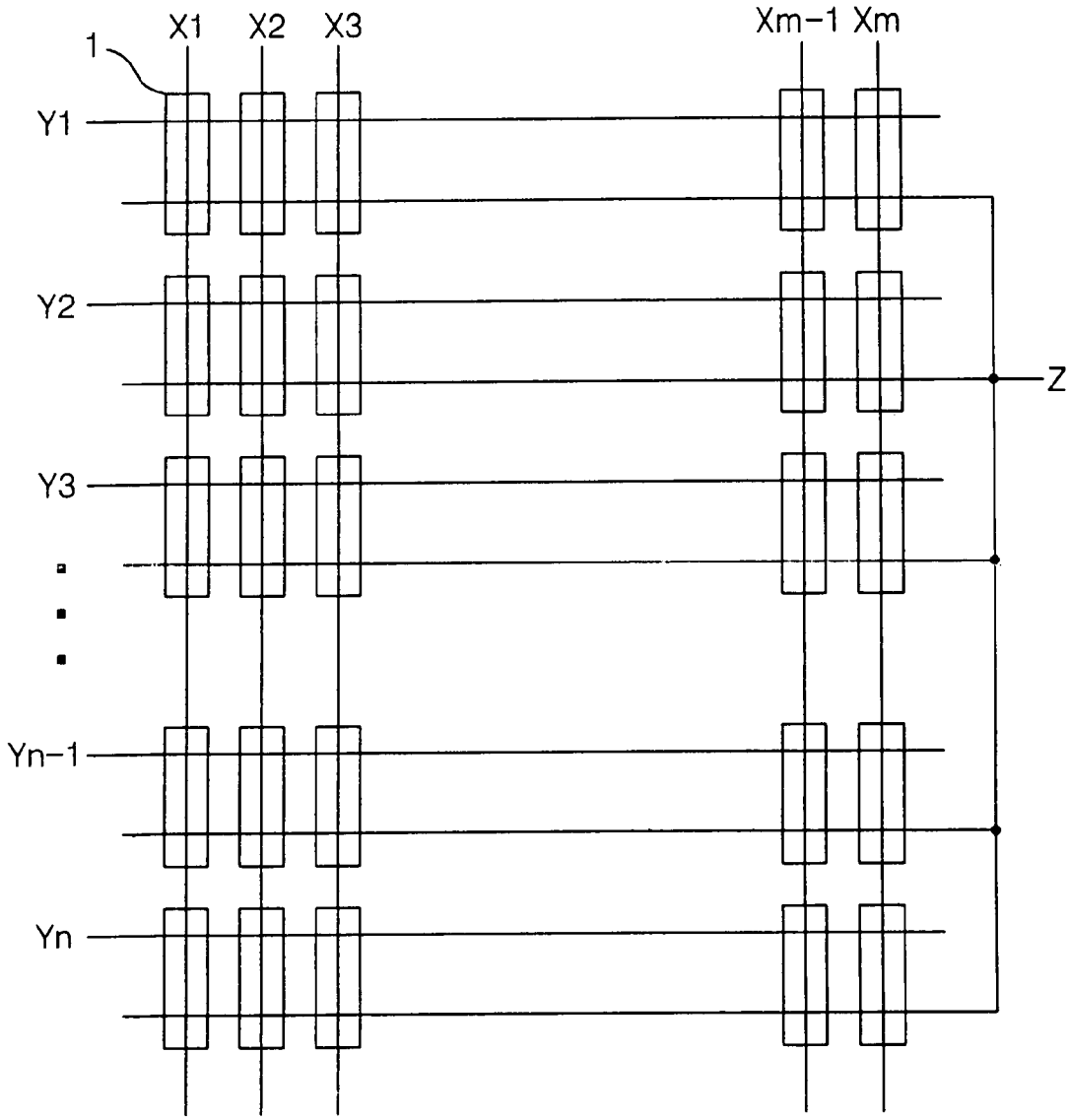
Related Art Fig. 1
FIG. 1 schematically illustrates the arrangement of electrodes of a conventional three-electrode AC surface-discharge type PDP.
Figure 2:
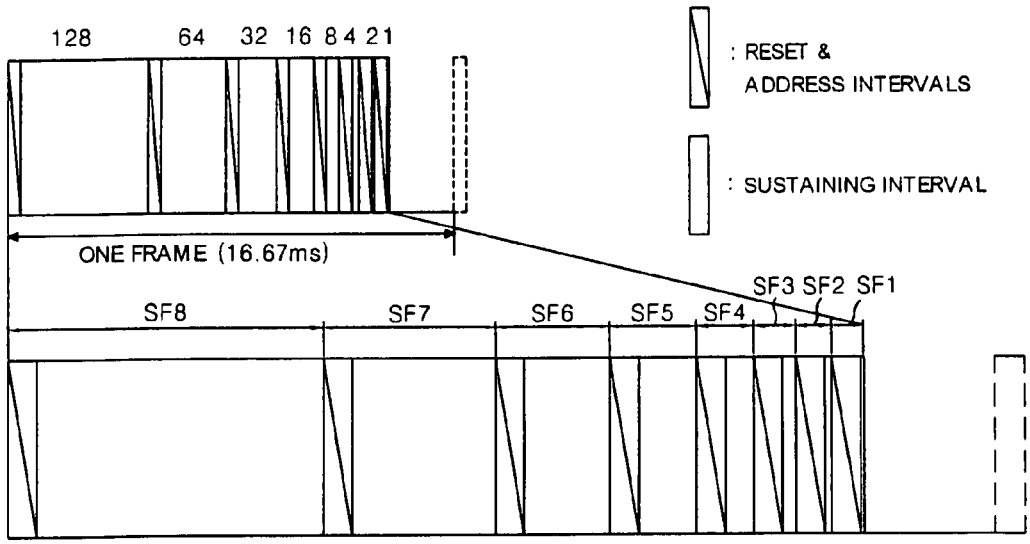
Fig. 2 Related Art
FIG. 2 illustrates the configuration of a frame of an 8-bit default code for achieving a 256-level gray scale.
Figure 3:
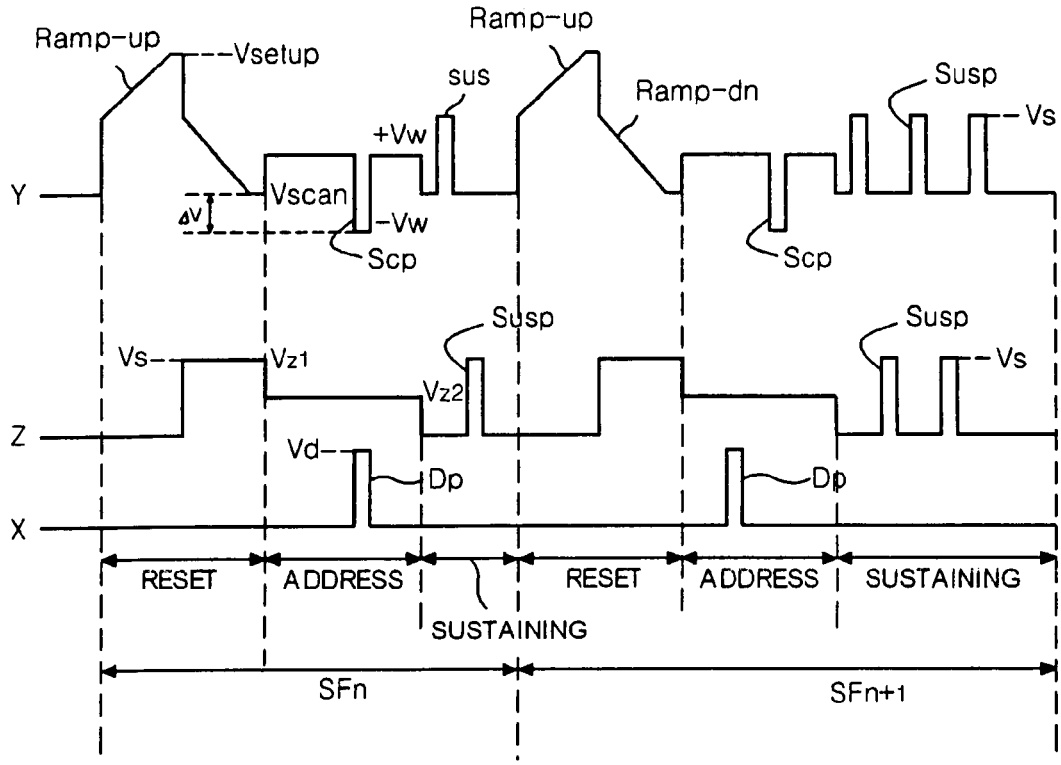
Related Art Fig. 3
FIG. 3 illustrates an example of a driving waveform for driving the conventional PDP.
Figure 4:
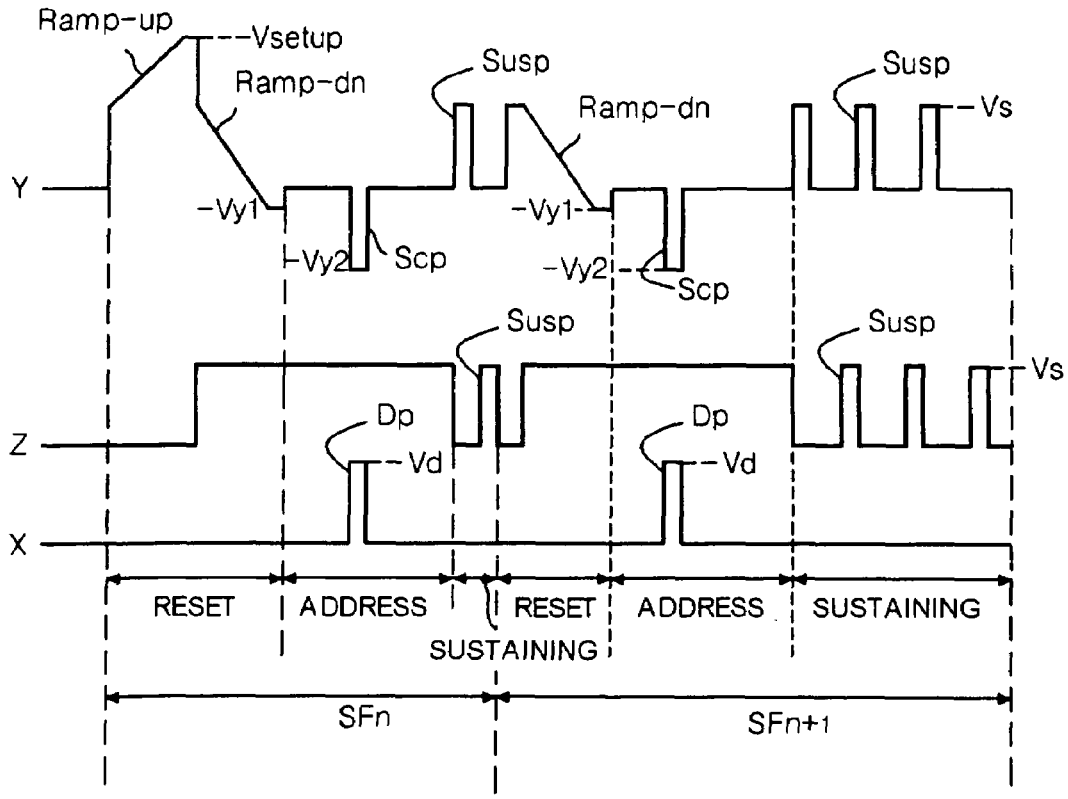
Fig. 4 Related Art
FIG. 4 illustrates another example of a driving waveform for driving the conventional PDP.
Figure 5:
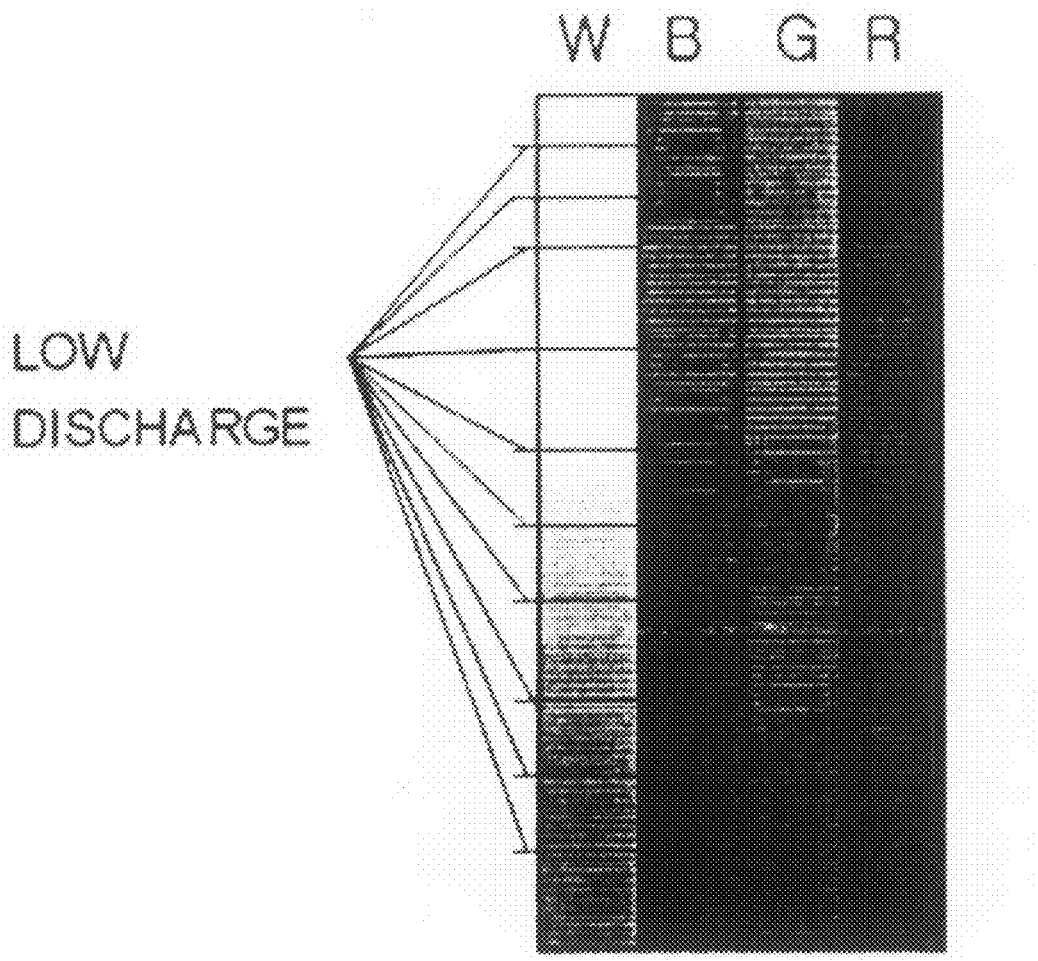
Fig. 5 Related Art
FIG. 5 illustrates an example of a gray scale showing a low discharge.

Reference will now be made in detail to the present preferred embodiments of the invention, examples of which are illustrated in the accompanying drawings.

A method for driving a plasma display panel according to an embodiment of the present invention includes the steps of initializing a cell by supplying a first write voltage and an erase voltage to a scanning electrode during a reset interval of the n-th sub-field; initializing the cell by supplying the erase voltage and a second write voltage which is higher than a sustaining voltage and lower than the first write voltage to the scanning electrode during a reset interval of the (n+1)-th sub-field; selecting the cell by supplying the scanning voltage to the scanning electrode and supplying a data voltage to an address electrode during an address interval of each of the n-th and (n+1)-th sub-fields; and alternatively supplying the sustaining voltage to the scanning and sustaining electrodes during a sustaining interval of each of the n-th and (n+1)-th sub-fields.

The method further includes the step of supplying a bias voltage to the address electrode before supplying the erase voltage in the second step.

Preferably, the first write voltage is the sustaining voltage.

A method for driving a plasma display panel according to another embodiment of the present invention includes the steps of: initializing a cell by supplying a write voltage and an erase voltage to a scanning electrode during a reset interval of the n-th sub-field; initializing the cell by supplying the write voltage and the erase voltage to the scanning electrode during a reset interval of the (n+1)-th sub-field and supplying a bias voltage to a sustaining electrode during a time interval between a starting time of supplying the write voltage and a starting time of supplying the erase voltage; selecting the cell by supplying the scanning voltage to the scanning electrode and supplying a data voltage to an address electrode during an address interval of each of the n-th and (n+1)-th sub-fields; and alternatively supplying the sustaining voltage to the scanning and sustaining electrodes during a sustaining interval of each of the n-th and (n+1)-th sub-fields.

An apparatus for driving a plasma display panel according to an embodiment of the present invention includes a first driver for supplying a first write voltage and a first erase voltage to a scanning electrode during a reset interval of the n-th sub-field and supplying a second erase voltage and a second write voltage which is higher than a sustaining voltage and lower than the first write voltage to the scanning electrode during a reset interval of the (n+1)-th sub-field; a second driver for supplying a scanning voltage to the scanning electrode and supplying a data voltage to an address electrode during an address interval of each of the n-th and (n+1)-th sub-fields; and a third driver for alternatively supplying a sustaining voltage to the scanning electrode and a sustaining electrode during a sustaining interval of each of the n-th and (n+1)-th sub-field.

The apparatus further includes a fourth driver for supplying a bias voltage to the address electrode before the second erase voltage is supplied during the reset interval of the (n+1)-th sub-field.

Preferably, the first write voltage is the sustaining voltage.

An apparatus for driving a plasma display panel according to another embodiment of the present invention includes a first driver for supplying a write voltage and an erase voltage to the scanning electrode during a reset interval of the n-th sub-field, supplying the write voltage and the erase voltage to the scanning electrode during a reset interval of the (n+1)-th sub-field, and supplying a bias voltage to a sustaining electrode during a time interval between a starting time of supplying the write voltage and a starting time of supplying the erase voltage; a second driver for supplying the scanning voltage to the scanning electrode and supplying a data voltage to an address electrode during an address interval of each of the n-th and (n+1)-th sub-fields; and a third driver for alternatively supplying the sustaining voltage to the scanning and sustaining electrodes during a sustaining interval of each of the n-th and (n+1)-th sub-fields.

Preferred embodiments of the present invention will be described in more detail with reference to FIGS. 6 to 10.

Figure 6:
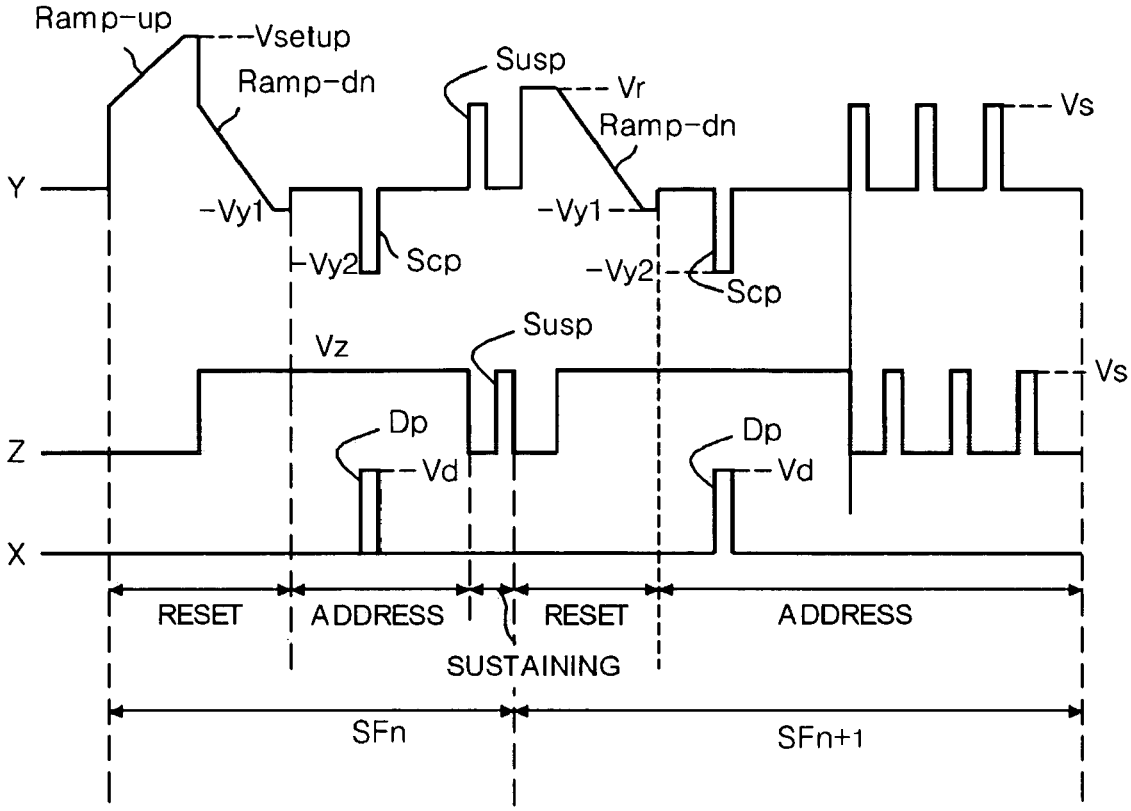
FIG. 6 is a waveform illustrating a PDP driving method according to a first embodiment of the present invention.

Referring to FIG. 6, one frame interval is time-divided into at least one n-th sub-field SFn and at least one (n+1)-th sub-field SFn+1. During the reset interval of the (n+1)-th sub-field SFn+1 having no set-up discharge, cells are initialized by a write discharge generated by supplying a reset voltage Vr higher than a sustaining voltage Vs to the scanning electrodes Y and by a set-down discharge generated by supplying a ramp-down waveform to the scanning electrodes Y.

During the reset interval of the n-th sub-field SFn, a ramp-up wave form of the setup voltage Vsetup is applied to the scanning electrodes Y, and at the same time, a 0V voltage is supplied to the sustaining electrodes Z and the address electrodes X. By the ramp-up waveform, a set-up discharge (for example, a write discharge) occurs between the scanning electrodes Y and the address electrodes X and between the scanning electrodes Y and the sustaining electrodes Z within the cells of the entire screen. By this set-up discharge, positive wall charges are created on the address electrodes X and the sustaining electrodes Z and negative wall charges are created on the scanning electrodes Y. After the ramp-up waveform is supplied, a ramp-down waveform falling gradually from a sustaining voltage Vs to a first negative voltage Vy1 is applied to the scanning electrodes Y. Simultaneously, a bias voltage Vz is supplied to the sustaining electrodes Z and a 0V voltage is supplied to the address electrodes Z. The sustaining voltage Vs may be selected as the bias voltage Vz. When the ramp-down waveform is supplied, a set-down discharge (for example, an erase discharge) occurs between the scanning electrodes Y and the sustaining electrodes Z. This set-down discharge erases excessive wall charges unnecessary for an address discharge out of the wall charges generated during the set-up discharge.

During the address interval of the sub-field SFn, a scanning pulse Scp of a second negative voltage Vy2 which is higher than the first negative voltage Vy1 in an absolute value is sequentially applied to the scanning electrodes Y, and at the same time, a data pulse Dp of a positive data voltage Vd synchronized with the scanning pulse Scp is applied to the address electrodes X. The voltage of the scanning pulse Scp, the voltage of the data pulse Dp and the wall voltage generated during the reset interval are added to create the address discharge within the cell to which the data pulse Dp is supplied. During this address interval, the bias voltage Vz is supplied to the sustaining electrodes Z.

During the sustaining interval of the n-th sub-field SFn, a sustaining pulse Susp of the sustaining voltage Vs is alternatively applied to the scanning electrodes Y and the sustaining electrodes Z. The cell selected by the address discharge creates a sustaining discharge between the scanning electrode Y and the sustaining electrode Z whenever each sustaining pulse Susp is applied, as the wall voltage within the cell is added to the sustaining voltage Vs.

During the reset interval of the (n+1)-th sub-field SFn+1, a reset voltage Vr which is higher than the sustaining voltage Vs and less than the setup voltage Vsetup is applied to the scanning electrodes Y for a prescribed time, causing a discharge to occur (for example, a write discharge). Thereafter, a reset ramp-down waveform falling gradually from the reset voltage Vr to the first negative voltage Vy1 is applied to the scanning electrodes Y, causing a discharge to occur (for example, a set-down discharge or an erase discharge). While the reset voltage Vr is supplied to the scanning electrodes Y, a 0V voltage is supplied to the sustaining electrodes Z and the address electrodes X. While the ramp-down waveform is supplied to the scanning electrodes Y, the bias voltage Vz is supplied to the sustaining electrodes Z and a 0V voltage is supplied to the address electrodes X. A write discharge occurs within the cell by the reset voltage Vr. By this write discharge, negative wall charges are created on the scanning electrodes Y and positive wall charges are created on the sustaining electrodes Z and the address electrodes X. By the ramp-down waveform, a set-down discharge occurs within the cell. This set-down discharge erases excessive wall charges unnecessary for an address discharge out of the wall charges generated during the write discharge caused by the reset voltage Vr by the set-down discharge.

During the address interval of the (n+1)-th sub-field SFn+1, the scanning pulse Scp of the second negative voltage Vy2 which is higher than the first negative voltage Vy1 in an absolute value is sequentially applied to the scanning electrodes Y, and at the same time, the data pulse Dp of the positive data voltage Vd synchronized with the scanning pulse Scp is applied to the address electrodes X. The voltage of the scanning pulse Scp, the voltage of the data pulse Dp and a wall voltage generated during the reset interval are added to create the address discharge within the cell. During this address interval, the bias voltage Vz is supplied to the sustaining electrodes Z.

During the sustaining interval of the (n+1)-th sub-field SFn+1, the sustaining pulse Susp of the sustaining voltage Vs is alternatively applied to the scanning electrodes Y and the sustaining electrodes Z. The cell selected by the address discharge creates a sustaining discharge between the scanning electrode Y and the sustaining electrode Z whenever each sustaining pulse Susp is applied, as the wall voltage within the cell is added to the sustaining voltage Vs.

In the PDP driving method of the PDP according to the first embodiment of the present invention, the write discharge is created by using the reset voltage Vr which is higher than the sustaining voltage Vs and lower than the set-up voltage Vsetup in the (n+1)-th sub-field SFn+1 without any set-up discharge. Then the amount of wall charges within the cell increases and a low discharge which may occur when there is no set-up discharge is prevented.

Figure 7:
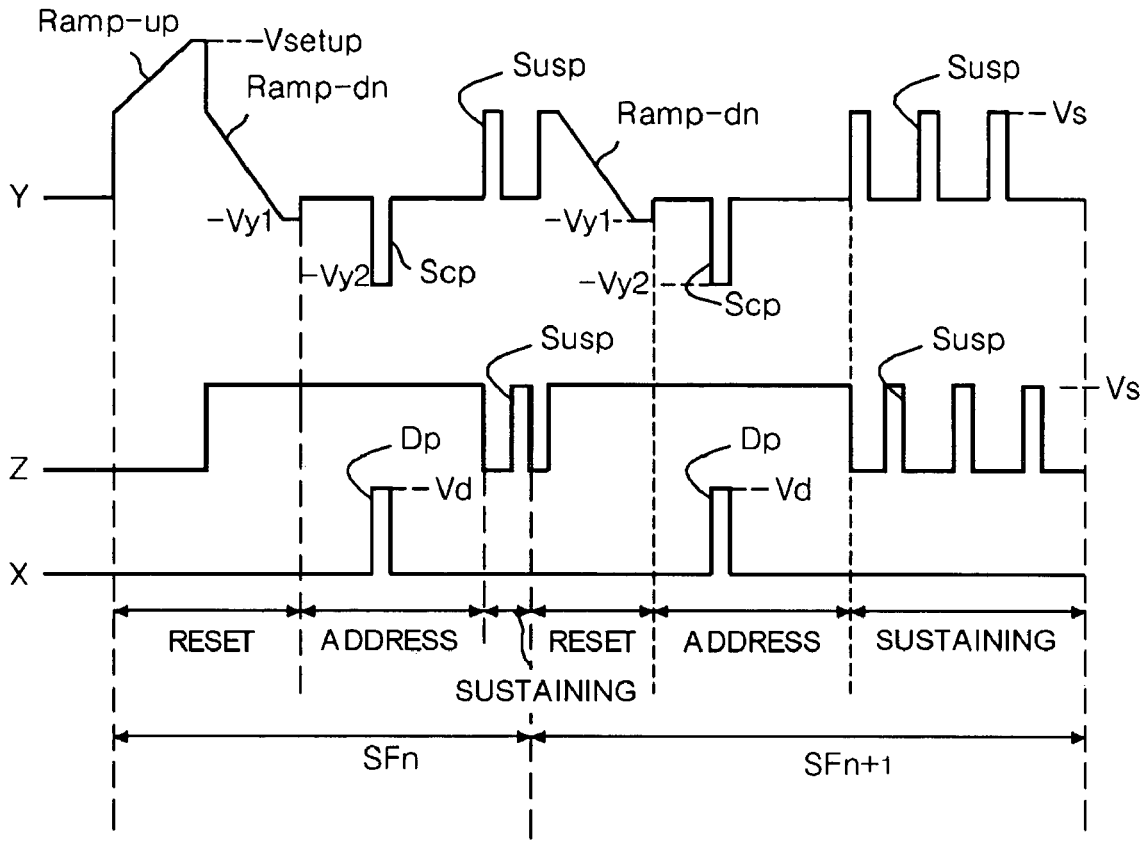
FIG. 7 is a waveform illustrating a PDP driving method according to a second embodiment of the present invention.
Figure 8:
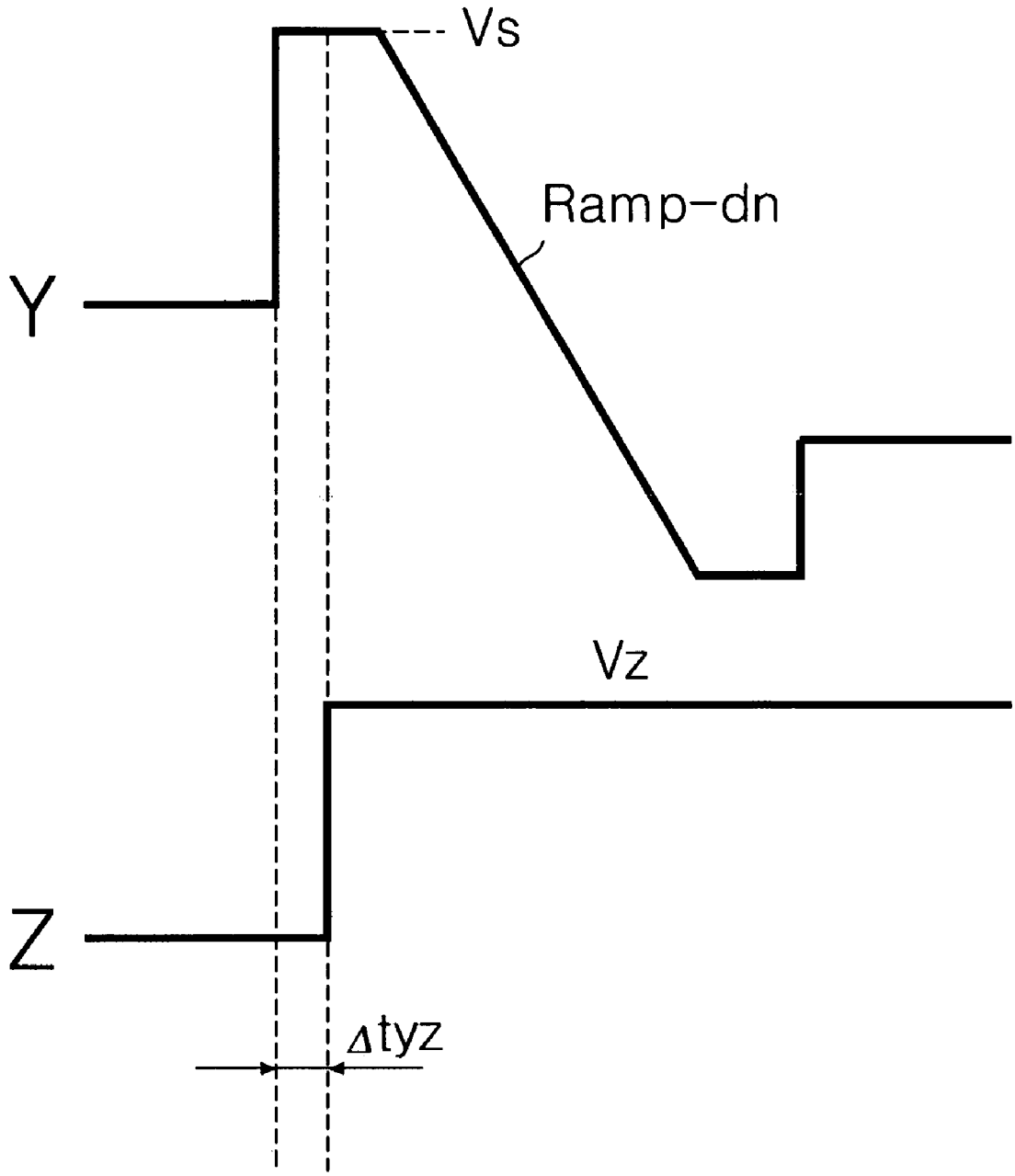
FIG. 8 is a enlarge waveform illustrating a time point of supplying a bias voltage to sustaining electrodes in the waveform shown in FIG. 7.

FIGS. 7 and 8 are waveforms illustrating a PDP driving according to a second embodiment of the present invention.

Referring to FIGS. 7 and 8, one frame interval is time-divided into at least one n-th sub-field SFn and at least one (n+1)-th sub-field SFn+1. During the reset interval of the (n+1)-th sub-field SFn+1 having no set-up discharge, the space charges are prevented from disappearing by supplying the bias voltage Vz to the sustaining electrodes Z immediately after the sustaining voltage Vs is supplied to the scanning electrodes Y.

The waveform supplied during the reset interval of the n-th sub-field SFn and its operational effect are the same as those shown in FIG. 6, and thus a detailed description thereof will not be given. Moreover, the waveforms supplied during the address and sustaining intervals of each of the n-th and (n+1)-th sub-fields SFn and SFn+1 and their operational effects are the same as those shown in FIG. 6, and thus a detailed description thereof will also not be given.

During the reset interval of the (n+1 l)-th sub-field SFn+1, the sustaining voltage Vs is applied to the scanning electrodes Y for a prescribed time. Thereafter, a ramp-down waveform falling gradually from the sustaining voltage Vs to the first negative voltage Vy1 is applied to the scanning electrodes Y. While the voltage on the scanning electrodes Y is maintained at the sustaining voltage Vs immediately after the sustaining voltage Vs is supplied to the scanning electrodes Y, the bias voltage Vz is supplied to the sustaining electrodes Z. The sustain voltage Vs may be selected as the bias voltage Vz.

That is, as shown in FIG. 8, the bias voltage Vz is supplied to the sustaining electrodes Z after a lapse of a time Δtyz after the sustaining voltage Vs is supplied to the scanning electrodes Y. By supplying this bias voltage Vz immediately after a discharge occurs by the sustaining voltage Vs supplied to the scanning electrodes Y, space charges formed by the discharge is prevented from disappearing. While the ramp-down waveform is supplied to the scanning electrodes Y, the bias voltage Vz is supplied to the sustaining electrodes Z and a 0V voltage is supplied to the address electrodes X. A discharge occurs within the cell by the sustaining voltage Vs supplied to the scan electrodes Y, for example a write discharge. By this discharge, negative wall charges are created on the scanning electrodes Y and positive wall carriers are created on the sustaining electrodes Z and the address electrodes X. A set-down discharge, for example an erase discharge, occurs within the cell by the ramp-down waveform, and excessive wall charges within the cell are erased.

On the other hand, the bias voltage Vz can be supplied immediately after the sustaining voltage Vs is supplied to the scanning electrodes Y as shown in FIGS. 7 and 8, or immediately after the reset voltage Vr is supplied to the scanning electrodes Y as shown in FIG. 6.

Figure 9:
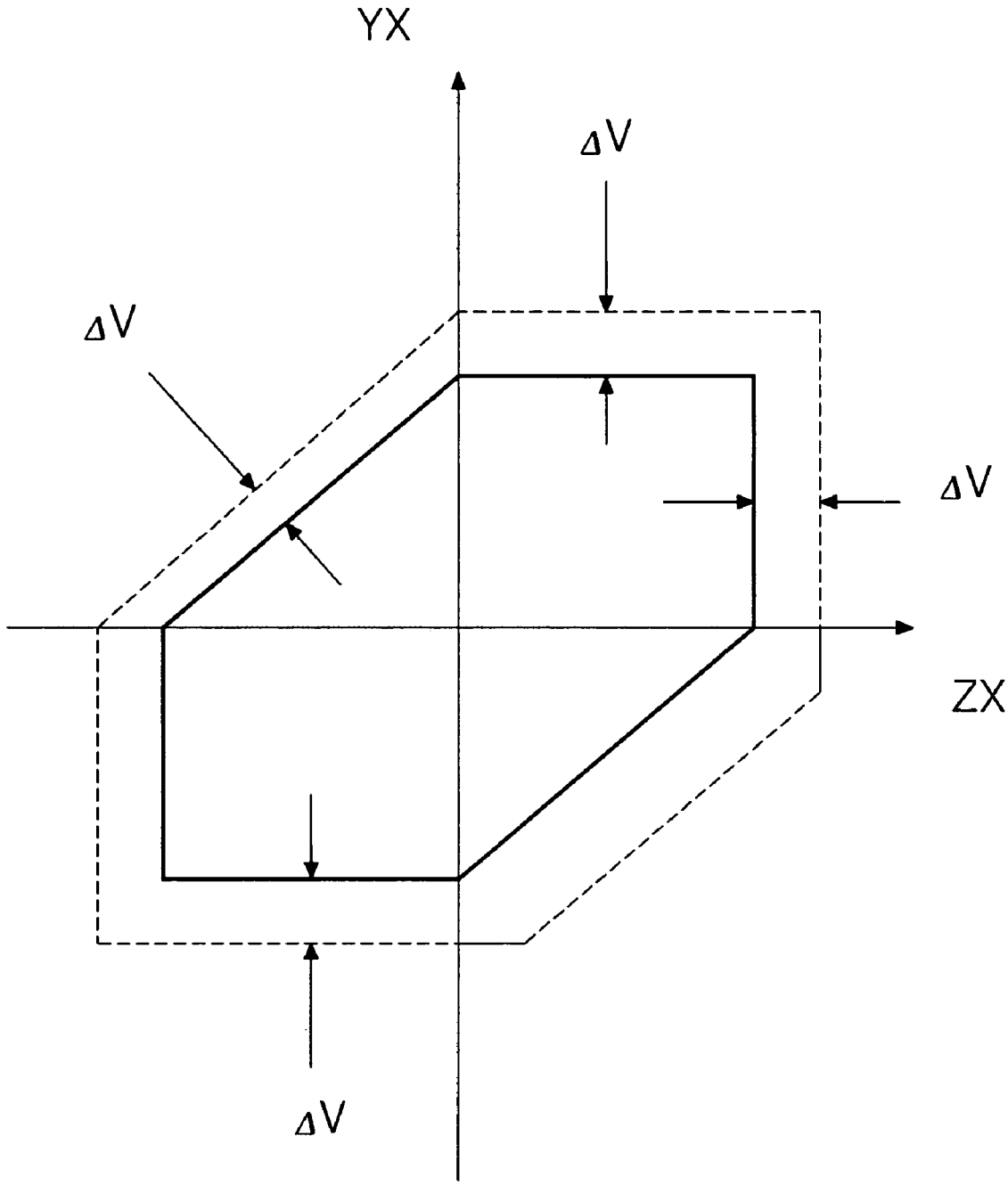
FIG. 9 is a voltage-closed curve illustrating a raising of a discharge voltage in a sub-field without a set-up discharge.

Consequently, as shown in a voltage-closed curve illustrated in FIG. 9, an increase of the discharge voltage raised to ΔV of a cell when there are no space charges in the (n+1)-th sub-field SFn+1 without the set-up discharge is compensated by raising the voltage of the scanning electrodes Y or advancing the supplying time of the positive bias voltage Vz to the sustaining electrodes Z. In FIG. 9, the axis of ordinates designates a discharge voltage between the scanning electrode Y and the address electrode X, and the axis of abscissa designates a discharge voltage between the sustaining electrode Y and the address electrode X.

Figure 10:
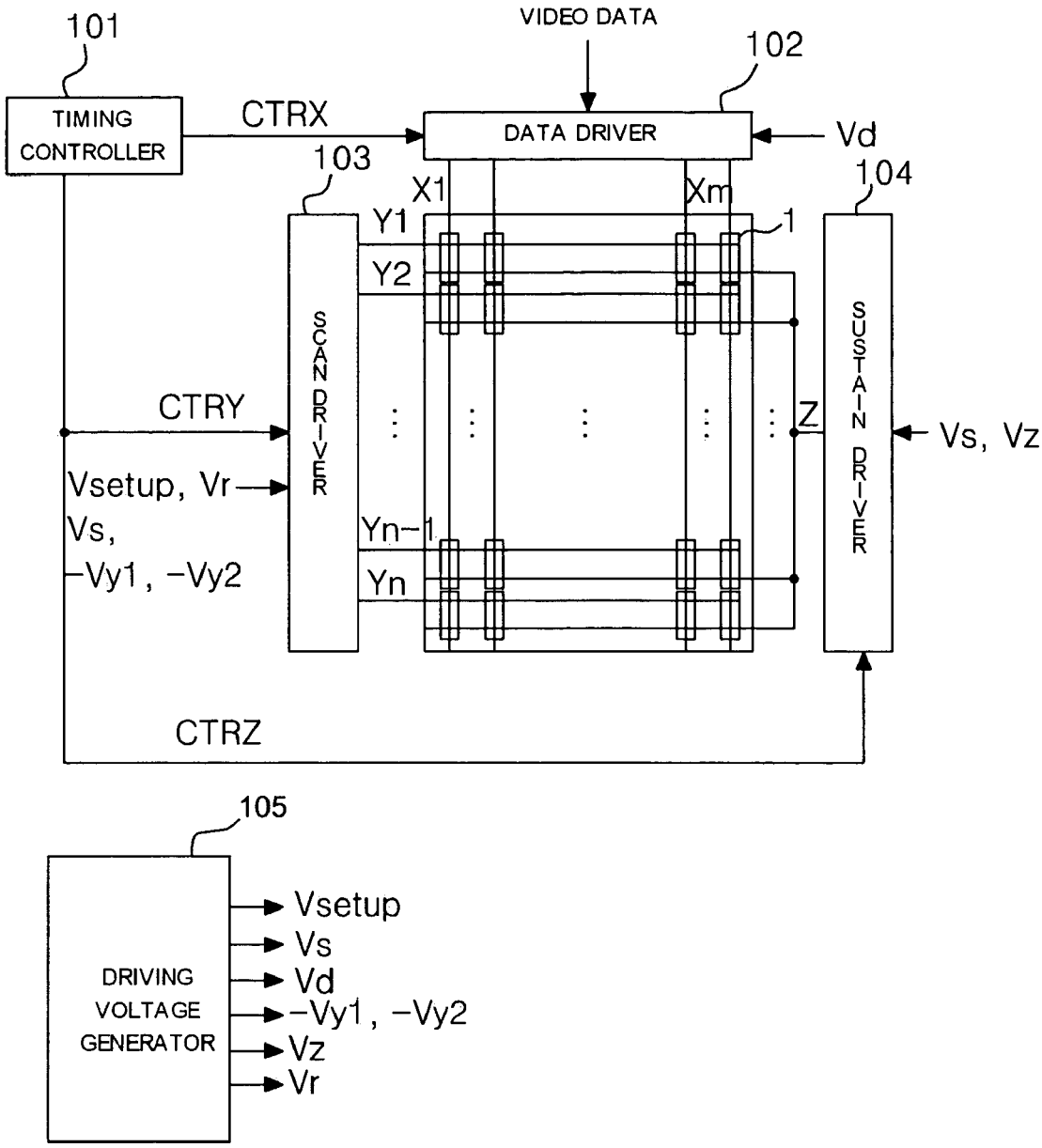
FIG. 10 is a block diagram illustrating a PDP driving apparatus according to an embodiment of the present invention.

FIG. 10 illustrates a PDP driving apparatus according to an embodiment of the present invention.

Referring to FIG. 10, the PDP driving apparatus includes a data driver 102 for supplying data to the address electrodes X1 through Xm, a scanning driver for driving the scanning electrodes Y1 through Yn, a sustaining driver 104 for driving the common sustaining electrodes Z, a timing controller 101 for controlling the drivers 102, 103 and 104, and a driving voltage generator 105 for supplying driving voltages necessary for the drivers 102, 103 and 104.

The data driver 102 undergoes inverse gamma correction and error diffusion by an inverse gamma correction circuit (not shown) and an error diffusion circuit (not shown). Data mapped to each sub-field by a sub-field mapping circuit is supplied to the data driver 102. The data driver 102 samples and latches data in response to a timing control signal CTRX received from the timing controller 101 and supplies the data to the address electrodes X1 through Xm.

The scanning driver 103 supplies the ramp-up and ramp-down waveforms to the scanning electrodes Y1 through Yn during the reset interval of the n-th sub-field SFn, and supplies the reset voltage VR higher than the sustaining voltage Vs and the wave-down waveform to the scanning electrodes Y1 through Yn during the reset interval of the (n+1)-th sub-field SFn+1, under the control of the timing controller 101. The scanning driver 103 sequentially supplies the scanning pulse Scp to the scanning electrodes Y1 through Yn during the address interval of each of the respective sub-fields SFn and SFn+1, and supplies the sustaining pulse Susp to the scanning electrodes Y1 through Yn during the sustaining interval.

The sustaining driver 104 supplies, in the n-th sub-field SFn, the bias voltage Vz to the sustaining electrodes Z during an interval of generating the ramp-down waveform SLP1 and during the address interval, under the control of the timing controller 101. Further, the sustaining driver 104 supplies, in the (n+1)-th sub-field SFn+1, the bias voltage Vz to the sustain electrodes z immediately after a discharge occurs by supplying the reset voltage Vr to the scanning electrodes Y, and supplies the bias voltage Vz to the sustaining electrodes Z during an interval of generating the ramp-down waveform SLP2 and during the address electrodes. Furthermore, the sustaining driver 104 supplies the sustaining pulse Susp to the sustaining electrodes Z by operating alternatively with the scanning driver 123 during the sustaining interval of each of the respective sub-fields SFn and SFn+1, under the control of the timing controller 101.

The timing controller 101 receives a vertical/horizontal synchronization signal and a clock signal, generates timing control signals CTRX, CTRY and CTRZ for controlling the operational timing and synchronization of the drivers 102, 103 and 104, and controls the drivers 102, 103 and 104 by supplying those control signals CTRX, CTRY and CTRZ to the corresponding drivers 102, 103 and 104. The data control signal CTRX includes a sampling clock for sampling data, a latch control signal, and a switch control signal for controlling an on/off time of an energy recovery circuit and a driving switch device. The scanning control signal CTRY includes a switch control signal for controlling an on/off time of an energy recovery circuit and a driving switch device within the scanning driver 103. The sustaining control signal CTRZ includes a switch control signal for controlling an on/off time of an energy recovery circuit and a driving switch device within the sustaining driver 104.

The driving voltage generator 50 generates the set-up voltage Vsetup, negative voltages Vy1 and Vy2 of the scanning electrode Y, sustaining voltage Vs, reset voltage Vr, data voltage Vd, bias voltage Vz, etc. Those driving voltages may vary with the composition of a discharge gas, the structure of a discharge cell, or the ambient temperature of the PDP.

On the other hand, the voltage level of the reset voltage Vr or the time point of supplying the sustaining bias voltage Vz may be different according to an average picture level of an input video, data load or ambient temperature.

A method and apparatus for driving a plasma display panel according to the present invention display an image by time-dividing a frame into at least one sub-field with a set-up discharge and at least one sub-field without a set-up discharge. In the sub-field without the set-up discharge, a write discharge is performed by a voltage higher than a sustaining voltage during an initial reset interval and then a cell initialized by a set-down discharge causing wall charges to be erased. Alternatively, immediately after s sustaining voltage is supplied to a scanning electrode, a positive bias voltage is supplied to a sustaining electrode without the set-up discharge. Therefore, contrast characteristics can be improved and a low discharge making a cell non-luminous at a specific gray scale can be prevented.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for driving a plasma display panel, comprising the steps of:

supplying a first re-set waveform to a scanning electrode during a reset interval of the n-th (n is a natural number) sub-field;

supplying a first scan pulse to the scanning electrode during an address interval of the n-th sub-field;

supplying a first sustain pulse to the scanning electrode during a sustaining interval of the n-th sub-field;

supplying a second re-set waveform to the scanning electrode during a reset interval of a (n+1)-th sub-field;

supplying a second scan pulse to the scanning electrode during an address interval of the (n+1)-th sub-field;

supplying a second sustain pulse to the scanning electrode during a sustaining interval of the (n+1)-th sub-field, wherein a peak voltage value of the second re-set waveform is less than a peak voltage value of the first re-set waveform and greater than a peak voltage value of the second sustain pulse, wherein the first re-set waveform comprises a first ramp-up waveform and a first ramp-down waveform, and wherein the first ramp-down waveform falls to a first negative voltage value and a voltage value of the first scan pulse is greater than the first negative voltage value in an absolute value.

2. The method as claimed in claim 1, further comprising the step of supplying a bias voltage to a sustaining electrode after supplying the second re-set waveform during the reset interval of the (n+1)-th sub-field.

3. The method as claimed in claim 2, wherein a peak voltage value of the bias voltage equals to a peak voltage value of the first sustaining pulse or the second sustaining pulse.

4. The method as claimed in claim 1, wherein the second re-set waveform comprises a second ramp-down waveform.

5. The method as claimed in claim 4 wherein the second ramp-down waveform falls to a second negative voltage value and a voltage value of the second scan pulse is greater than the second negative voltage value in an absolute value.

6. The method as claimed in claim 4 further comprising the step of supplying a bias voltage to a sustaining electrode before a starting time of supplying the second ramp-down waveform during the reset interval of the (n+1)-th sub-field.

7. The method as claimed in claim 1, wherein the second re-set waveform comprises the steps of:

increasing to a peak voltage value of the second re-set waveform;

maintaining the peak voltage value of the second re-set waveform; and decreasing from the peak voltage value of the second re-set waveform to a second negative voltage value, wherein a bias voltage is provided to a sustaining electrode during the peak voltage value of the second re-set waveform is supplied to the scanning electrode.

8. A method for driving a plasma display panel, comprising the steps of:

supplying a first re-set waveform to a scanning electrode during a reset interval of the n-th (n is a natural number) sub-field;

supplying a first scan pulse to the scanning electrode during an address interval of the n-th sub-field;

supplying a first sustain pulse to the scanning electrode during a sustaining interval of the n-th sub-field;

supplying a second re-set waveform to the scanning electrode during a reset interval of the (n+1)-th sub-field;

supplying a second scan pulse to the scanning electrode during an address interval of the (n+1)-th sub-field;

supplying a second sustain pulse to the scanning electrode during a sustaining interval of the (n+1)-th sub-field, wherein the second re-set waveform comprises a second ramp-down waveform and a bias voltage is supplied to a sustaining electrode before supplying the second ramp-down waveform during the reset interval of the (n+1)-th sub-field, wherein the first re-set waveform comprises a first ramp-up waveform and a first ramp-down waveform, and wherein the first ramp-down waveform falls to a first negative voltage value and a voltage value of the first scan pulse is greater than the first negative voltage value in an absolute value.

9. The method as claimed in claim 8, wherein the second re-set waveform comprises a second ramp-down waveform.

10. The method as claimed in claim 9, wherein the second ramp-down waveform falls to a second negative voltage value and voltage value of the second scan pulse is greater than the second negative voltage value in an absolute value.

11. The method as claimed in claim 9, further comprising the step of supplying a bias voltage to a sustaining electrode before supplying the second ramp-down waveform during the reset interval of the (n+1)-th sub-field.

12. The method as claimed in claim 8, wherein a peak voltage value of the second re-set waveform is equal to a peak voltage value of the second sustaining pulse.

13. The method as claimed in claim 8, wherein a peak voltage value of the bias voltage is equal to a peak voltage value of the second sustaining pulse.

* * * * *